US005154190A

United States Patent [19]

Heitmann

[11] Patent Number: 5,154,190

[45] Date of Patent: Oct. 13, 1992

[54] APPARATUS FOR BUILDING A TOBACCO STREAM

[75] Inventor: Uwe Heitmann, Hamburg, Fed. Rep. of Germany

[73] Assignee: Körber AG, Hamburg, Fed. Rep. of Germany

[21] Appl. No.: 738,475

[22] Filed: Jul. 31, 1991

[30] Foreign Application Priority Data

Aug. 17, 1990 [DE] Fed. Rep. of Germany ..... 4026055

[51] Int. Cl.[5] ..... A24C 5/14

[52] U.S. Cl. ..... 131/84.1; 131/84.3

[58] Field of Search ..... 131/84.1, 84.3, 84.4

[56] References Cited

U.S. PATENT DOCUMENTS

| | | | |
|---|---|---|---|
| 3,518,911 | 7/1970 | Niemann | 83/338 |
| 3,736,941 | 6/1973 | Molins et al. | 131/84.3 |
| 4,185,644 | 1/1980 | Heitmann | 131/109 R |
| 4,580,579 | 4/1986 | Wahle et al. | 131/84.1 X |
| 4,651,754 | 3/1987 | Lorenzen et al. | 131/84.1 X |
| 4,651,755 | 3/1987 | Rudszinat | 131/84.4 |
| 4,732,164 | 3/1988 | Heitmann | 131/84.4 |
| 4,875,494 | 10/1989 | Siems | 131/84.1 |
| 4,889,138 | 12/1989 | Heitmann et al. | 131/84.1 |
| 4,998,540 | 3/1991 | Brand | 131/84.1 X |

FOREIGN PATENT DOCUMENTS 2729730 11/1986 Fed. Rep. of Germany .

*Primary Examiner*—Vincent Millin
*Assistant Examiner*—J. Doyle
*Attorney, Agent, or Firm*—Peter K. Kontler

[57] ABSTRACT

A cigarette rod making machine wherein the apparatus which supplies tobacco particles to the stream building zone at the underside of a belt conveyor is designed to prevent entry of fragments of tobacco ribs into the outer layer of the stream. This is achieved by directing fragments of tobacco ribs into that portion of the stream which is to form the core of the filler of the cigarette rod and/or by directing fragments of tobacco ribs into that portion of the stream which is removed by a trimming device ahead of the station where the thus obtained filler is draped into a web of cigarette paper. Absence of fragments of tobacco ribs in the outer layer of the filler reduces the likelihood of piercing the web of cigarette paper at the wrapping station. Advancement of fragments of tobacco ribs into those portions of the stream which are to form the outer layer or the filler can be ensured or assisted by the additional expedient of designing the classifying device or devices of the distributor in the rod making machine in such a way that they cannot advance the relatively heavy fragments of tobacco ribs along those sections of the path leading to the stream building station which convey particles for the formation of the outer layer of the trimmed stream.

14 Claims, 2 Drawing Sheets

APPARATUS FOR BUILDING A TOBACCO STREAM

BACKGROUND OF THE INVENTION

The invention relates to apparatus for building a stream of fibrous material, particularly to improvements in apparatus for building a stream which contains or consists of tobacco particles. Still more particularly, the invention relates to improvements in apparatus for building a stream of fibrous material which is to be draped in cigarette paper or other relatively thin and weak wrapping material such as is likely to be damaged as a result of contact with relatively hard and/or relatively sharp particles.

As used herein, the term "tobacco" is intended to denote natural, artificial and reconstituted tobacco as well as all forms of natural tobacco including tobacco leaves, tobacco leaf laminae, tobacco ribs as well as fragments of tobacco leaves, laminae and ribs. The following description will deal primarily with the making of tobacco streams which are to be converted into the fillers of cigarette rods. However, the invention can be practiced with equal or similar advantage in connection with the making of streams which are to be converted into rod-like fillers of cigars, cigarillos and/or other rod-shaped smokers' products.

The making of cigarettes normally involves preliminary treatment of tobacco particles and introduction of such particles into the distributor (also called hopper) of a rod making machine. The distributor furnishes a relatively wide and relatively thin layer or carpet of loosened tobacco particles, and such carpet is then conveyed against the underside of the lower reach of an endless foraminous belt conveyor which cooperates with a suction chamber to gather a stream containing a surplus of tobacco particles. The surplus is removed by a so-called trimming or equalizing device, and the thus obtained rod-like filler (trimmed tobacco stream) is draped into a web of cigarette paper to form a cigarette rod which is severed by a so-called cutoff to yield plain cigarettes of unit length or multiple unit length.

In many or most instances, the carpet of loosened tobacco particles contains shredded tobacco leaf laminae as well as fragments of tobacco ribs. The fragments of ribs are normally heavier and harder than the shreds of tobacco leaf laminae; therefore, the distributor of a cigarette rod making machine normally comprises one or more classifying devices which segregate fragmentized tobacco ribs from shreds of tobacco leaf laminae because the fragments of ribs are highly likely to puncture and/or otherwise damage the tubular envelope consisting of cigarette paper or other wrapping material which is used to surround the trimmed or equalized tobacco stream. It has been found that even repeated classifying of tobacco particles in the distributor is not likely to result in segregation of all or practically all fragments of tobacco ribs, i.e., the cigarette rod is likely to embody a tubular wrapper which is punctured at one or more locations to permit uncontrolled escape of tobacco smoke and/or uncontrolled flow of air into the rod-like tobacco filler of a cigarette, be it a plain cigarette or a filter cigarette. In either event, the presence of holes in the wrappers of plain or filter cigarettes is irritating to the smoker and detracts from the appearance and other desirable qualities of the ultimate product.

OBJECTS OF THE INVENTION

An object of the invention is to provide an apparatus which can be used in a rod making machine of the tobacco processing industry to form a trimmed or equalized rod-like filler of tobacco and which is constructed and assembled in such a way that relatively hard and/or relatively heavy particles of fibrous material, such as fragments of tobacco ribs, are less likely to damage the wrapper than in rod making machines employing heretofore known apparatus.

Another object of the invention is to provide a novel and improved apparatus which can be used for the making of a stream of fibrous material and is constructed and assembled in such a way that the wrapper is less likely or unlikely to be punctured and/or otherwise damaged by fragments of tobacco ribs or other relatively heavy and/or relatively hard particles of fibrous material than in heretofore known apparatus even though the percentage of heavier particles in the stream is the same as, or even higher than, in the streams which are turned out by conventional apparatus.

A further object of the invention is to provide the apparatus with novel and improved means for controlling the distribution of lighter and heavier particles of fibrous material in the rod-like filler of a cigarette rod making machine or another rod making machine of the tobacco processing industry.

An additional object of the invention is to provide a rod making machine which can turn out a high-quality wrapped rod-like filler of tobacco.

Still another object of the invention is to provide a novel and improved method of reducing the likelihood of damage to the wrapper of a cigarette rod.

A further object of the invention is to provide a novel and improved distributor for use in a rod making machine of the tobacco processing industry.

An additional object of the invention is to provide a wrapped tobacco containing rod wherein the wrapper is devoid of holes of the type normally formed by sharp fragments of tobacco ribs and/or other relatively hard and/or relatively heavy particles of fibrous material.

A further object of the invention is to provide a novel and improved cigarette maker.

Another object of the invention is to provide a novel and improved method of treating particles of fibrous material on their way toward the trimming or equalizing device in a rod making machine of the tobacco processing industry.

SUMMARY OF THE INVENTION

The invention is embodied in an apparatus for building a stream of fibrous material of the tobacco processing industry from a mixture of randomly distributed lighter and heavier particles, for example, to form a rod-like filler of tobacco particles in a cigarette making machine. The improved apparatus comprises means for advancing the mixture in the form of a relatively wide layer or carpet (hereinafter called carpet) in a predetermined direction along a first path having first and second sections (such as longitudinally extending strips or zones of the first path), a conveyor having portions which extend across the sections of the first path to intercept the oncoming particles and to transport the intercepted particles in the form of a stream along a second path, and means for preventing the heavier particles (if any) which advance along the first sections of the first path from reaching those portions of the conveyor which extend across the first sections of the first path.

The apparatus can further comprise an equalizing or trimming device having means (such as particle clamping discs and a rotary paddle wheel or gear at one side of the discs) for removing particles from the stream in the second path, and means for thereafter draping the thus trimmed or equalized stream into a web of cigarette paper or other suitable wrapping material. One second section of the first path then preferably contains particles which are removed by the equalizing device, and another second section of the first path preferably contains particles which constitute a core of the equalized stream. This ensures that the heavier particles are removed by the equalizing device prior to draping of the equalized stream into wrapping material and/or that the heavier particles are contained in the core of the equalized stream, i.e., in that part of the equalized stream which is remote from the wrapping material. Since the heavier particles are much more likely to constitute particles of tobacco ribs than the lighter particles, the wrapper of the equalized stream is less likely to be damaged (e.g., punctured) in the course of the wrapping operation because the heavier particles are removed by the equalizing device prior to draping and/or are contained only in the core of the equalized stream.

At least one of the first sections of the first path contains particles which form an outer layer surrounding the core of the equalized stream. Such particles are lighter particles since the heavier particles which advance along the first sections of the first path are prevented from reaching the corresponding portions of the conveyor.

The apparatus can further comprise means (such as one or more pneumatic classifying devices) for segregating at least some of the heavier particles from the mixture upstream and/or downstream of the preventing means. The preventing means can be positioned in such a way that it is adjacent the segregating means, particularly the segregating means downstream of the preventing means.

The preventing means can include means for diverting heavier particles from the first sections into the second sections of the first path. Such diverting means can include at least two guides for heavier particles, and such at least two guides can diverge in the predetermined direction (of advancement of particles of the mixture toward the aforementioned portions of the conveyor). At least one of the guides can include at least one sheet-, panel- or plate-like deflector for heavier particles.

If the segregating means comprises means for pneumatically conveying the particles in the predetermined direction, a portion of the preventing means can form part of the conveying means, and such part of the conveying means is then operative to convey (either primarily or exclusively) lighter particles along the first sections of the first path, i.e., the heavier particles are simply prevented from advancing all the way to the corresponding portions of the conveyor and are segregated from the first path by gravity or in any other suitable way. The aforementioned guide or guides of the preventing means can be located upstream or downstream of the segregating means, depending on the selected locus of the segregating means in the first path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
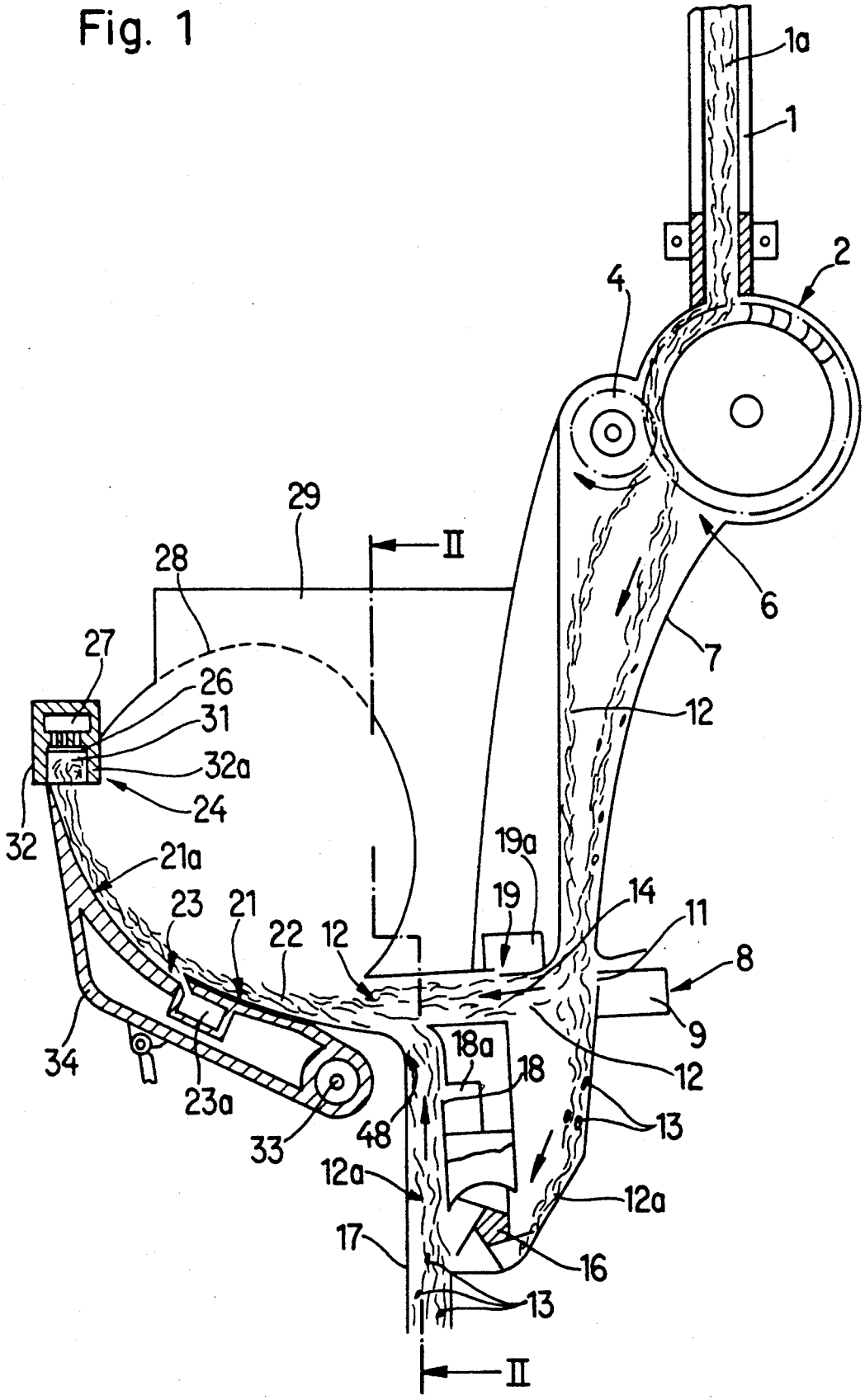
FIG. 1 is a fragmentary schematic partly elevational and partly vertical sectional view of an apparatus which embodies one form of the invention and is installed in a cigarette rod making machine.

FIG. 1 shows certain parts of a distributor or hopper in a cigarette rod making machine, e.g., a machine of the type described and shown in commonly owned U.S. Pat. No. 4,185,644 to Heitmann et al. The illustrated portion of the distributor includes an upright duct 1 which gathers a column 1*a* of randomly distributed lighter and heavier tobacco particles 12, 12*a* and 13. As a rule, or at least in most instances, the lighter particles 12 and 12*a* are shreds of tobacco leaf laminae and the heavier particles 13 are or include fragments of tobacco ribs. The upper end of the duct 1 receives a continuous stream or discrete batches of intermixed tobacco particles 12, 12*a* and 13 from a magazine (not shown) by way of a suitable conveyor, e.g., an elevator conveyor of the type shown in FIGS. 1-2 of the patent to Heitmann et al. or in German Pat. No. 27 29 730.

The means 2 for withdrawing a continuous shower 6 of intermixed randomly distributed tobacco particles 12, 12*a* and 13 from the lower end of the gathering duct 1 comprises a driven carded wheel 3 which entrains particles from the lower end of the column 1*a*, and a rapidly rotating picker roller 4 which expels the particles from the carding of the wheel 3 and propels the thus obtained shower 6 into a gravity flow channel 7. The latter resembles a funnel which narrows in a downward direction and conveys successive increments of the mixture or shower 6 into the range of a classifying device 8 serving to segregate heavier particles 13 from the lighter particles 12. A certain classifying action is also performed by the picker roller 4 which propels the heavier particles 13 (together with some lighter particles 12*a* which are entangled with the heavier particles) against the right-hand wall of the channel 7 whereas the lighter particles 12 advance primarily along the left-hand wall of the channel 7 and are separated from the mixture of particles 12*a* and 13.

The classifying device 8 can be said to constitute an accelerator of lighter particles 12 and comprises one or more nozzles 11 serving to discharge streams or jets of compressed air or another gas from a plenum chamber 9 in such a way that the streams or jets advance transversely of the direction of downward movement of tobacco particles 12, 12*a* and 13 in the channel 7. Such jets or streams entrain the lighter particles 12 in the direction of arrow 14.

The heavier particles 13 traverse the jets or streams of compressed gas issuing from the nozzle or nozzles 11 and entrain the lighter particles 12*a* in the same direction. The particles 12*a* can constitute a relatively small percentage of all lighter particles in the mixture or shower 6 which is formed by the picker roller 4. The mixture of particles 12*a* and 13 descends into the range of a rotary cell wheel gate 16 which serves to evacuate the heavier particles 13 into a collecting receptacle or onto a conveyor, not shown. The lighter particles 12*a* also pass through the gate 16 but are thereupon caused to rise in a classifying duct 17 due to the injector effect of one or more nozzles 18 which discharge streams or jets of compressed air or another gas from a plenum chamber 18*a*. The jets or streams which issue from the nozzle or nozzles 18 are directed upwardly to entrain the lighter particles 12*a* into the path for the previously segregated lighter particles 12. The thus formed relatively thin but relatively wide layer or carpet 22 of loose lighter particles 12 and 12*a* advances in the direction of arrow 14 along a path which is defined in part by the concave upper side of a composite guide 21. In order to ensure predictable advancement of the carpet 22 along the path which is defined by the guide 21, the distributor of FIG. 1 further comprises one or more nozzles 19 which discharge jets or streams of compressed air or another gas from a plenum chamber 19*a*, and one or more nozzles 23 which discharge jets or streams of compressed air or another gas from a plenum chamber 23*a* downstream of the junction where the rising lighter particles 12*a* are admixed to the flow of lighter particles 12. The nozzle or nozzles 19 are adjacent the nozzle or nozzles 11 of the classifying device 8.

The duct 17, the nozzle or nozzles 18 and the plenum chamber 18*a* constitute a second pneumatic classifying device which segregates the lighter particles 12*a* from the heavier particles 13 so that the carpet 22 is substantially free of heavier particles 13. Some heavier particles 13 are likely to reach the carpet 22 for a variety of reasons. Thus, some heavier particles 13 can be interlaced with a clump or batch of lighter particles 12 which are propelled by the jets or streams of air issuing from the nozzles 11 and 19. Furthermore, some of the heavier particles 13 are likely to be intermingled with the lighter particles 12*a* which rise in the duct 17 under the influence of jets or streams of gas issuing from the nozzle or nozzles 18. The particles of the carpet 22 and the mass of air or another gas which is supplied by the nozzles 11, 18, 19 and 23 form a so-called wall stream which closely conforms to and advances along the concave upper side or surface of the guide 21. If necessary, the distributor of FIG. 1 can comprise one or more additional nozzles or sets of nozzles and a corresponding number of additional plenum chambers to ensure predictable advancement of the carpet 22 along the guide 21 and toward and into a tobacco channel 31 at the underside of the lower reach of an endless foraminous belt conveyor 26 (see also FIG. 2). The channel 31 has two sidewalls or cheeks 32, 32*a* which flank and extend downwardly from the underside of the lower reach of the conveyor 26, and the wedge-like left-hand portion 21*a* of the guide 21 is positioned to direct successive increments of the carpet 22 into the channel 32 and against the underside of the lower reach of the conveyor 26. In order to ensure an optimum positioning of the wedge-like portion relative to the adjacent cheek 32*a* of the tobacco channel 32, the portion 21*a* of the guide 21 preferably forms part of a carrier 34 (which contains the aforementioned plenum chamber 23*a* and carries the nozzle or nozzles 23), and this carrier is pivotable at 33 about a horizontal axis so that it can be moved in a counterclockwise or in a clockwise direction. When moved in a counterclockwise direction beyond the position of FIG. 1, the carrier 34 enables the portion 21*a* of the guide 21 to afford convenient access to the interior of that portion of the distributor which contains the nozzle or nozzles 19 and the plenum chamber 19*a*. This is desirable to ensure rapid determination and elimination of causes of malfunction.

The lower reach of the belt conveyor 26 is located beneath the perforated bottom wall of a suction chamber 27 which has an outlet connected to a suction generating device (e.g., a pump or a fan) to ensure that the particles 12, 12*a* (and the particles 13, if any) which are supplied by the guide 21 into the channel 31 adhere to and form at the underside of the lower reach of the conveyor 26 a stream (FIG. 2) which is caused to advance along a second path (arrow 40 in FIG. 2) toward and past a preferably adjustable surplus or excess removing trimming or equalizing device 36 which removes the surplus or excess 47 to leave a trimmed or equalized filler or stream 37 which is ready to be draped into a web of cigarette paper or other suitable wrapping material in a manner not shown in the drawing.

A suitable trimming or equalizing device is described and shown in commonly owned U.S. Pat. No. 4,732,164 to Heitmann and in commonly owned U.S. Pat. No. 4,651,755 to Rudszinat. U.S. Pat. No. 4,732,164 to Heitmann further shows a portion of a wrapping mechanism which is used to drape an equalized stream or filler into a web of cigarette paper to form a cigarette rod which is thereupon severed by a cutter, known as cutoff, to yield a succession of plain cigarettes of unit length or multiple unit length. A suitable cutoff is described and shown in U.S. Pat. No. 3,518,911 to Niemann et al.

Figure 2:
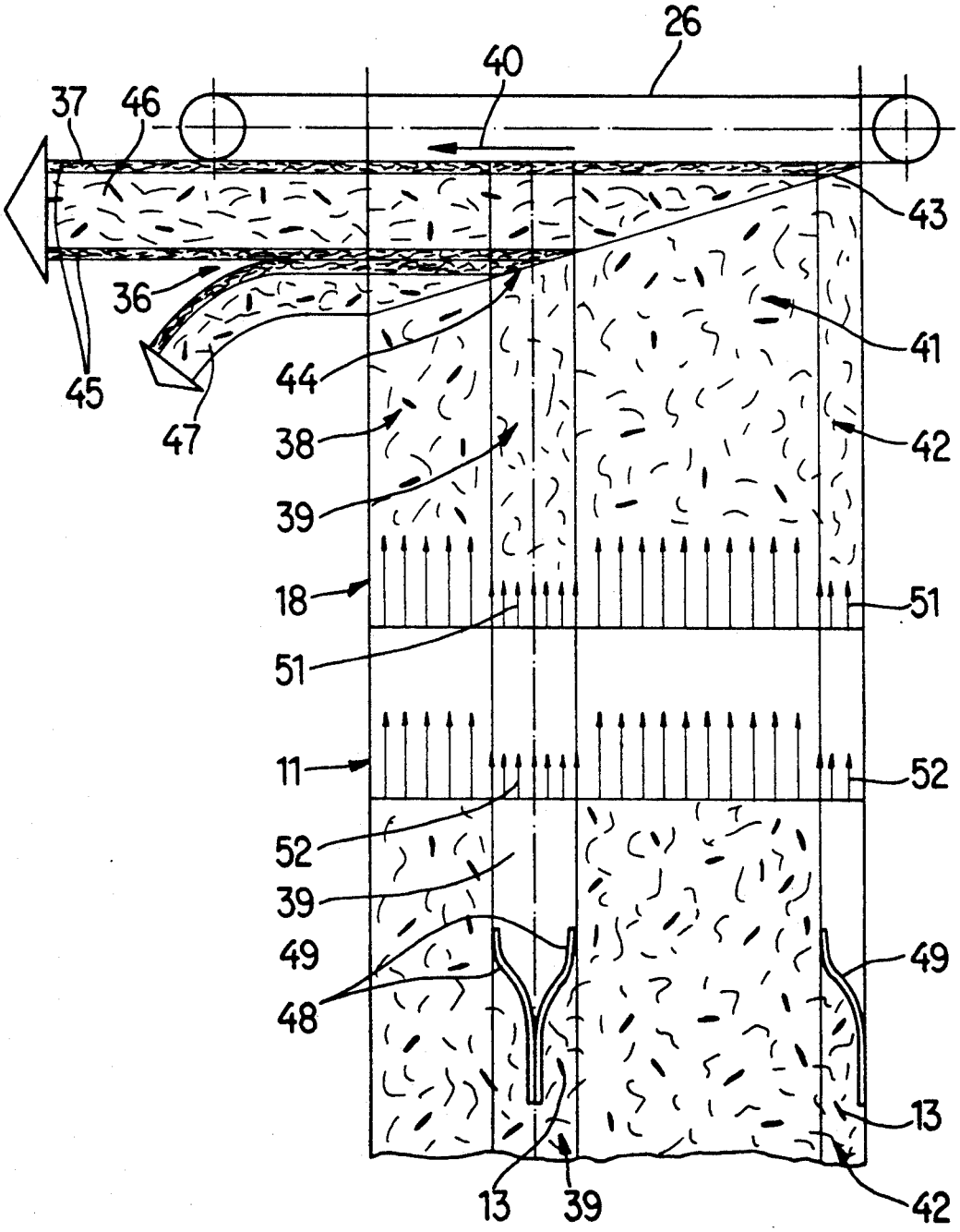
FIG. 2 is an enlarged view of a detail substantially as seen in the direction of arrows from the line II—II in FIG. 1.

Any heavier particles 13 which would be permitted to enter or remain the outer layer 45 surrounding the core 46 of the trimmed or equalized stream or filler 37 would be likely to damage (particularly puncture) the relatively thin and weak web or strip of cigarette paper which is draped around the equalized stream downstream of the trimming device 36. Therefore, the apparatus which is shown in FIGS. 1 and 2 comprises means for preventing penetration of heavier particles 13 (if any are present in the shower 6) into the outer layer 45 where the heavier particles could come in contact with the tubular envelope of the cigarette rod.

In accordance with a feature of the invention, the elongated (first) path which is defined by the channel 7, by the guide 21 and by the classifying devices 8 and 17, 18, 18*a* is subdivided into four imaginary sections or strips which extend in the direction of arrow 14 and each of which delivers tobacco particles against a discrete portion of the lower reach of the conveyor 26 in a stream building zone 24 in the tobacco channel 31, namely above the tip of the wedge-shaped portion 21*a* of the guide 21. The first path includes two first sections 39, 42 and two second sections 38, 41 which alternate with the first sections. The section 42 delivers lighter tobacco particles 12 and 12*a* which are used to build a first portion of the outer layer 45 of the equalized stream 37, and such particles reach the portion 43 of the stream building zone 24 at the underside of the lower reach of the conveyor 26. The section 39 delivers particles 12 and 12*a* which are to form another portion of the outer layer 45 and reach the portion 44 of the stream building zone 24. Some of the particles which are delivered along the path section 42 form part of the surplus or excess 47 which is removed by the trimming device 36 to be returned into the magazine of the distributor in a manner as disclosed, for example, in commonly owned U.S. Pat. No. 4,875,494 to Siems.

The second section 38 of the first path delivers particles 12, 12*a* and (if present) 13 into that portion of the stream building zone 24 where the major part of the surplus or excess 47 is added to the unequalized stream (37+47). The second section 41 of the first path delivers particles 12 and 12*a* (and 13, if present) to that portion of the conveyor 26 which accumulates the core 46 of the equalized stream 37. The presence of some (or even a relatively high percentage of) heavier particles 13 in the surplus or excess 47 is of no consequence since such surplus is removed by the trimming device 36 ahead of the station where the trimmed stream or filler 37 is draped into a web of cigarette paper. The same holds true for the presence (if any) of heavier particles 13 in the core 46, i.e., such core is surrounded by the outer layer 45 and, therefore, its particles do not come in direct contact with cigarette paper.

The aforementioned preventing means includes mechanical deflectors 49 which are installed in the path sections 39 and 42 and serve to steer the heavier particles 13 into the neighboring sections 38 and 41. The right-hand deflector 49 of FIG. 2 is located in the section 42 which is adjacent the wall 48 of the duct 17 and, therefore, this deflector comprises a single sheet-, panel- or plate-like guide which directs at least the heavier particles 13 from the section 42 into the adjacent section 41. The deflector 49 in the section 39 has two divergent branches because this deflector is located in the section 39, i.e., between the sections 38 and 41. One branch of the deflector 49 in the section 39 diverts heavier particles 13 into the section 41 and the other branch of the deflector in the section 39 diverts particles 13 into the section 38. The illustrated deflectors 49 are assumed to be installed in the duct 17 upstream of and close to the nozzle 18 of the classifying device which further includes the plenum chamber 18*a*. The deflectors 49 can be said to be located downstream of the first classifying device 8 including the nozzle or nozzles 11 and the plenum chamber 9 because the path for the majority of heavier particles 13 which would be likely to reach the guide 21 (i.e., that portion of the carpet 22 which is on its way into the tobacco channel 31 and is about to be intercepted by the lower reach of the conveyor 26) extends through the cell wheel gate 16 and upwardly through the duct 17. The deflectors 49 are or can be affixed to the wall 48 of the duct 17.

The aforementioned preventing means can further include a portion which is constituted by or includes the classifying device 8 and/or the classifying device 17, 18, 18*a*. Thus, the pressure of air or another gas which is confined in the plenum chamber 9 can be selected in such a way that the jet or jets of gas issuing from the nozzle or nozzles 11 are incapable of deflecting some, or any appreciable number of, heavier particles 13 from their path toward the cell wheel gate 16. Analogously, the pressure in the plenum chamber 18*a* can be selected in such a way that the jets or streams of gas issuing from the nozzle or nozzles 18 are incapable of entraining heavier particles 13 in and upwardly beyond the duct 17. This is indicated in FIG. 2 by relatively short arrows 51 which denote the entraining action of jets or streams of compressed gas issuing from the nozzle or nozzles 18, and by relatively short arrows 52 which denote the entraining action of jets or streams of compressed gas issuing from the nozzle or nozzles 11. As shown in FIG. 2, the arrangement is preferably such that the nozzle or nozzles 11 and 18 are designed to emit relatively weak streams or jets of compressed gas only for transport of particles 12 and/or 12*a* along the sections 39 and 42 of the path which is defined by the advancing means including the two classifying devices and the guide 21. Such design of the nozzles 11 and 18 ensures that the heavier particles 13 which would have advanced along the path sections 39 and 42 are compelled to descend by gravity or to be otherwise prevented from advancing with the carpet 22 all the way into the stream building zone 24 at the underside of the lower reach of the conveyor 26.

The classifying device 8 is preferably designed to be effective across the full width of the path for advancement of lighter particles 12 toward the guide 21, and the classifying device including the parts 17, 18 and 18*a* is preferably also designed to be effective across the full width of the path for advancement of lighter particles 12*a* toward the junction with the lighter particles 12. However, and as already mentioned above, the classifying action of the two classifying devices can be selective so that these classifying devices form part of the aforementioned preventing means in that their nozzles 11 and 18 are designed not to advance heavier particles 13 (if any are present) along the sections 39 and 42 of the path for the particles which form the carpet 22.

An important advantage of the improved apparatus is that the cigarette rod is less likely to comprise a tubular envelope which is punctured by fragments of ribs and/or other relatively heavy and/or relatively sharp particles of fibrous material. This contributes to more satisfactory quality of the rod and of the ultimate products, such as plain or filter cigarettes. Moreover, heavier particles 13 are prevented from reaching the wrapper in a simple manner without necessitating even minor reductions of the speed of the rod making machine. The improved apparatus can be readily installed in existing rod making machines to contribute to a significant improvement of the quality of rod-shaped smokers' products. The width of sections 39, 42 of the path for advancement of tobacco particles to the conveyor 26 (i.e., to the stream building zone 24) can be selected with a view to reliably prevent the presence of heavier particles 13 in the outer layer 45 of the trimmed or equalized stream or filler 37 and to thus ensure that the wrapper of cigarette paper or other suitable wrapping material is highly unlikely to be pierced and/or otherwise damaged by fragments of tobacco ribs during passage through the wrapping mechanism or thereafter.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for building a stream of fibrous material of the tobacco processing industry from a mixture of randomly distributed lighter and heavier particles, comprising means for advancing the mixture in the form of a carpet in a predetermined direction along a first path having first and second sections; a conveyor having portions extending across said sections of said first path to intercept the oncoming particles and to transport the intercepted particles in the form of a stream along a second path; and means for preventing the heavier particles which advance along the first sections of said first path from reaching those portions of said conveyor which extend across said first sections, said preventing means including means for diverting heavier particles from the first sections into the second sections of said first path.

2. The apparatus of claim 1, further comprising an equalizing device having means for removing particles from the stream in said second path, and means for thereafter draping the thus equalized stream into a web of wrapping material, one of said second sections of said first path containing particles which are removed by said equalizing device and another of said second sections of said first path containing particles which constitute a core of the equalized stream.

3. The apparatus of claim 2, wherein at least one of said first sections of said first path contains particles which form an outer layer surrounding the core of the equalized stream.

4. The apparatus of claim 1, further comprising means for segregating some of the heavier particles from the mixture upstream of said preventing means.

5. The apparatus of claim 1, further comprising means for segregating some of the heavier particles from the mixture in said first path downstream of said preventing means.

6. The apparatus of claim 5, wherein said preventing means is adjacent said segregating means.

7. The apparatus of claim 1, wherein said diverting means comprises at least two guides for heavier particles, at least one of said guides having portions diverging in said predetermined direction.

8. The apparatus of claim 7, wherein said guides include sheet or plate-like deflectors for heavier particles.

9. The apparatus of claim 1, further comprising means for segregating some of the heavier particles from the mixture in said first path, said segregating means including means for pneumatically conveying the particles in said direction and said preventing means including a portion forming part of said conveying means and being operative to convey primarily lighter particles toward said conveyor along the first sections of said first path.

10. The apparatus of claim 9, wherein said preventing means further comprises a portion downstream of said conveying means.

11. The apparatus of claim 9, wherein said preventing means further comprises a portion upstream of said conveying means.

12. The apparatus of claim 1, further comprising means for segregating some of the heavier particles from the mixture in said first path, said segregating means including means for pneumatically conveying the particles in said direction and said preventing means including a portion forming part of said conveying means and being operative to convey exclusively lighter particles toward said conveyor and along the first sections of said first path.

13. The apparatus of claim 12, wherein said preventing means further comprises a portion downstream of said conveying means.

14. The apparatus of claim 12, wherein said preventing means further comprises a portion upstream of said conveying means.

* * * * *